US006750190B2

(12) United States Patent
Colurciello et al.

(10) Patent No.: US 6,750,190 B2
(45) Date of Patent: Jun. 15, 2004

(54) ALKALINE CLEANING AND SANITIZING COMPOSITION EFFECTIVE FOR SOAP SCUM REMOVAL

(76) Inventors: Andrew Francis Colurciello, 13 Archery Rd., Newburgh, NY (US) 12550; Mark Timothy Bennett, 12 Ridge Rd., West Milford, NJ (US) 07480; Albert Thomas Weibel, 30 Piney Branch Rd., Cranbury, NJ (US) 08512

( * ) Notice: Subject to any disclaimer, the term of this patent is extended or adjusted under 35 U.S.C. 154(b) by 0 days.

(21) Appl. No.: 10/450,219

(22) PCT Filed: Nov. 19, 2001

(86) PCT No.: PCT/GB01/05120

§ 371 (c)(1),
(2), (4) Date: Oct. 27, 2003

(87) PCT Pub. No.: WO02/48299

PCT Pub. Date: Jun. 20, 2002

(65) Prior Publication Data

US 2004/0072711 A1 Apr. 15, 2004

(30) Foreign Application Priority Data

Dec. 15, 2000 (GB) ..... 0030608

(51) Int. Cl.[7] ..... C11D 1/835; C11D 3/48

(52) U.S. Cl. ..... 510/362; 510/238; 510/384; 510/391; 510/421; 510/432; 510/503; 510/504; 510/509

(58) Field of Search ..... 510/238, 384, 510/362, 391, 421, 432, 503, 504, 509

(56) References Cited

U.S. PATENT DOCUMENTS

| | | | | |
|---|---|---|---|---|
| 5,948,741 A | | 9/1999 | Ochomogo et al. | 510/191 |
| 6,013,615 A | * | 1/2000 | Zhou et al. | 510/434 |

FOREIGN PATENT DOCUMENTS

| | | | |
|---|---|---|---|
| EP | 0 621 335 A2 | 10/1994 | C11D/1/835 |
| EP | 0 691 397 A2 | 1/1996 | C11D/3/00 |
| GB | 2 148 928 A | 6/1985 | C11D/10/04 |
| GB | 2 340 503 A | 2/2000 | C11D/1/835 |
| GB | 2 353 043 A | 2/2001 | C11D/1/83 |
| GB | 2 370 042 A | 6/2002 | C11D/3/00 |
| WO | 00/09644 | 2/2000 | C11D/11/00 |

OTHER PUBLICATIONS

PCT International Search Report, dated Jan. 22, 2002, for PCT/GB01/05120.

* cited by examiner

*Primary Examiner*—Charles Boyer
(74) *Attorney, Agent, or Firm*—Norris McLaughlin & Marcus, P.A.

(57) ABSTRACT

Alkaline cleaning and sanitizing compositions which are essentially free of chelating agents based on organic acid compound, especially nitrogen containing chelating agents, which composition is particularly directed for the effective removal of soap scum stains on hard surfaces. The compositions of the present invention are particularly adapted to be used as a 'ready-to-use' type composition, as well as in a non-pressurized container which is supplied with a hand pumpable trigger spray apparatus. The present invention is also directed to the use of such a composition in the cleaning or sanitization of a hard surface, as well as methods for producing such compositions.

10 Claims, No Drawings

ALKALINE CLEANING AND SANITIZING COMPOSITION EFFECTIVE FOR SOAP SCUM REMOVAL

The present invention is directed to ready to use hard surface cleaning compositions. More particularly the present invention is directed to alkaline cleaning and sanitizing compositions which are essentially free of chelating agents based on organic acid compound, especially nitrogen containing chelating agents, which composition is particularly directed for the effective removal of soap scum stains on hard surfaces which comprises. The compositions of the present invention are particularly adapted to be used as a 'ready-to-use' type composition, as well as in a non-pressurized container which is supplied with a hand pumpable trigger spray apparatus. The present invention is also directed to the use of such a composition in the cleaning or sanitization of a hard surface, as well as methods for producing such compositions.

As is known to the art, hard surfaces associated with lavatories (including lavatory appliances especially washing sinks, shower stalls and bathtubs) are typically prone to accumulate soap scum stains. Such surfaces are usually made of materials such as tiles (glazed and unglazed), marble, ceramics and enameled porcelain surfaces. The latter include European porcelain surfaces which generally are more prone to damage or discoloration due to the use of particularly aggressive cleaning compositions, especially those with low pH values. Thus, acid cleaning compositions are desirably to be avoided for use in cleaning such surfaces. The use of alkaline cleaning compositions are therefore preferred, however most alkaline cleaning compositions are not sufficiently satisfactory to effectively clean soap scum stains from surfaces. This shortcoming has been met in the art by the require the inclusion of an effective amount of a chelating agent which is typically based on one or more organic acid compounds, especially nitrogen containing organic compounds which include a plurality of carboxylic acid groups. Such chelating agents include gluconic acid, tartartic acid, citric acid, oxalic acid, lactic acid, ethylenediamine mono-, di- or tri-acetic acid, ethylenedianinetetraacetic acid, N-hydroxyethylethylenediarnine triacetic acid, nitrilotriacetic acid, diethylene triamine pentaacetic acid, and their water soluble salts of these compounds, especially the alkali metal salts and particularly the sodium salts.

While such a chelating agents, particularly nitrogen containing chelating agents are generally recognized in the art as being effective in the removal of soap scum stains, there are growing environmental concerns attendant upon their use. The use of such chelating agents based on organic acid compounds, especially nitrogen containing organic compounds which include a plurality of carboxylic acid groups especially ethylenediamine mono-, di- or tri-acetic acid, ethylenediaminetetraacetic acids are desirably to be avoided.

According to a preferred aspect of the invention there is provided an alkaline ready to use cleaning and sanitizing composition which is essentially free of a chelating agent based on a nitrogen containing chelating agents, which composition is particularly adapted to be used as a 'ready-to-use' type composition, as well as in a non-pressurized container which is supplied with a hand pumpable trigger spray apparatus and which is particularly directed for the effective removal of soap scum stains on hard surfaces. The inventive composition comprises:

an amine oxide surfactant;

a nonionic alkoxylated alcohol surfactant;

a germicide constituent, preferably a germicidal cationic surfactant, and most preferably a water miscible or water soluble quaternary ammonium compound having germicidal properties;

organic solvent constituent, preferably a glycol ether;

an carbonate constituent, preferably an alkali metal or alkaline earth metal carbonate constituent;

an hydroxide constituent, preferably an alkali metal or alkaline earth metal hydroxide constituent;

optionally, a minor amount of one or more conventional additives including coloring agents, fragrances, opacificers, thickening agents, pH adjusting agents, buffers; and, water.

According to particularly preferred embodiments the total amounts of the surfactants do not exceed 2.0% wt., more desirably do not exceed 1.75%, and more preferably do not exceed 1.25% wt. It is a surprising and advantageous feature of the inventive compositions that very effective cleaning of soap scum, and sanitization of hard surfaces is achieved in such a ready to use composition which contains such a low level of surfactants and at the same time being essentially free of chelating agents based on organic acid compounds, especially nitrogen containing organic compounds and particularly those which include a plurality of carboxylic acid groups.

The compositions according to the invention include one or more amine oxide surfactants. Preferably the amine oxide surfactant may be represented by the following structure:

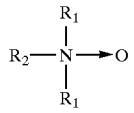

wherein:

each R1 independently is a straight chained or branched $C_1$–$C_4$ alkyl group, but preferably both R1 are methyl groups; and, R2 is a straight chained or branched $C_8$–$C_{18}$ alkyl group, preferably is a $C_8$–$C_{12}$ alkyl group. Preferably, each of the R1 and R2 are straight chained. Technical grade mixtures of two or more amine oxides may be used, wherein amine oxides of varying chains of the R2 group are present. Particularly preferred are the amine oxides shown in the Examples.

The water dispersible amine oxide of the compositions of the invention is preferably present in an amount of from 0.25–0.75% wt., and more preferably is present in an amount of about 0.4–0.6% wt., based on the total weight of the composition.

The compositions of the invention include one or more nonionic alkoxylated alcohol surfactants. Suitable nonionic surfactants include condensation products of alkylene oxide groups with an organic hydrophobic compound, such as an aliphatic or alkyl aromatic compound.

Preferred nonionic surfactants are those based on the condensation product of one mole of an aliphatic alcohol having from 8 to 18 carbon atoms with from 1 to about 10 moles of alkylene oxide. These resultant reaction products include alkoxylated, especially ethoxylated and/or propoxylated linear alcohols as well as non-linear alcohols, and such alcohols expressly include primary, secondary as well as tertiary alcohols. Such materials are per se, known to the art.

Very preferably the nonionic surfactant is based an alkoxylated (ethoxylated, propoxylated) aliphatic linear fatty alcohol which is ethoxylated to a degree of from 6 to 12 moles of ethylene oxide per mole of alcohol. As known to the art, such materials are generally supplied as technical grade mixtures of one or more linear fatty alcohols which are predominantly ethoxylated. Most preferably the nonionic surfactant is based on alkoxylated linear $C_{12}$–$C_{16}$ aliphatic alcohol having an average of about 8–10 moles of ethoxylation per mol of alcohol, especially where such alcohols are primary alcohols. Such materials are presently commercially available as in the NEODOL series of alcohol ethoxylates (Shell Chem. Co.) as well as in the GENAPOL series of alcohol ethoxylates (Clariant Chem. Co.).

The inventive compositions also include a germicide constituent which is effective against gram positive bacteria or gram negative bacteria, but preferably against both. Desirably the germicide constituent is at least one cationic surfactant which is found to provide a broad antibacterial or sanitizing function. Any, cationic surfactant which satisfies these requirements may be used and are considered to be within the scope of the present invention, and mixtures of two or more cationic surface active agents, viz., cationic surfactants may also be used.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

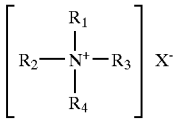

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atom. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quatemary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are particularly useful in the practice of the present invention include those which have the structural formula:

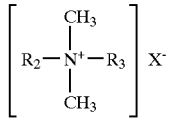

wherein $R_2$ and $R_3$ are the same or different $C_8$-$C_{12}$ alkyl, or $R_2$ is $C_{12}$-$C_{16}$ alkyl, $C_{8-18}$ alkylethoxy, $C_{8-18}$ alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Particularly useful quaternary germicides include which are a available under the tradenames BARQUAT, BARDAC, HYAMINE, BTC or LONZABAC (Each of these recited materials are presently commercially available from Lonza, Inc., Fairlawn, N.J. and/or from Stepan Co., Northfield Ill.) Particularly preferred are the quaternary ammonium compounds described in the Examples.

The germicidal constituent may be present in any effective amount, but generally need not be present in amounts in excess of about 5% wt. based on the total weight of the composition. The preferred germicidal cationic surfactant(s) may be present in the concentrated liquid disinfectant compositions in amounts of from about 0.001% by weight to up to about 0.5% by weight, preferably about 0.01–0.25% by weight, most preferably in amount of between 0.5–0.10% by weight.

The compositions of the invention include an organic solvent constituent.

Useful organic solvents are those which are at least partially water-miscible such as alcohols, water-miscible ethers (e.g. diethylene glycol diethylether, diethylene glycol dimethylether, propylent glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethyleneglycol or propylene glycol (e.g. propylene glycol monomethyl ether acetate) all commercially available such as from Union Carbide, Dow Chemicals or Hoescht. Mixtures of such organic solvents can also be used.

Particularly preferred as the organic solvent constituent in this invention are the glycol ethers having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Preferred are glycol ethers having one to five glycol monomer units. These are $C_3$–$C_{20}$ glycol ethers. Examples of more preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. More preferably employed as the solvent is one or more of the group consisting of ethylene glycol n-butyl ether, diethylene glycol n-butyl ether, and mixtures thereof. Most preferably, the organic solvents are those which are described with reference to the Examples.

The organic solvent constituent, and especially the preferred glycol ether solvent, is preferably employed in an amount ranging from about 1–12% wt. based on the total weight of the composition.

The compositions of the invention are alkaline in nature, and may be exemplified as having a pH of at least 10 and higher, particularly a pH of 11 and higher, and especially at a pH of 12 and higher. It is generally required to include a minor but effective amount of an alkaline material in order to adjust the pH of the compositions to the desired alkaline pH. Conventional materials may be used including for example carbonates such as potassium carbonate, sodium bicarbonate and especially sodium carbonate. It is to be appreciated that the carbonate constituent aids in adjusting the alkalinity of the compositions, typically to a pH of about 11, but the use of an additional amount of a caustic may raise the pH to the preferred pH of 12 and above is normally required. This hydroxide constituent is provided in an amount which is found to be effective in facilitating the removal of soap scum stains from hard surfaces, particularly lavatory and kitchen surfaces. Good results are attained when the hydroxide constituent is present in an amount of from 0% wt. to about 0.2% wt., especially from 0.1% wt. to 0.2% wt. based on the total weight of the composition of which it forms a part.

The carbonate constituent is provided in an amount which is found to be effective in facilitating the removal of soap scum stains from hard surfaces, particularly lavatory and kitchen surfaces. Advantageously the carbonate constituent is present in an amount of from 2% wt. to about 7% wt., especially from 2% wt. to 5% wt. based on the total weight of the composition of which it forms a part.

The compositions of the invention show excellent efficacy in the removal of soap scum at high pHs, and do not deleteriously affect so called European enamel surface.

The inventive compositions optionally, but in certain instances desirably, may include a minor amount of one or more conventional additives including coloring agents, fragrances, opacificers, thickening agents, pH adjusting agents, buffers in addition to the required constituents described above. These further optional additives may be present in any combinations and in any suitable amount that is sufficient for imparting the desired properties to the compositions, and it is to be understood that in accordance with particularly preferred embodiments of the invention, the inventive compositions are essentially free of conventional chelating agents. These one or more conventional additives, when present, should be present in minor amounts, preferably in total comprise less than about 5% by weight of the compositions, and desirably less than about 3% wt.

As discussed above, in particularly preferred embodiments the inventive compositions are essentially free of chelating based on organic acid compounds, especially nitrogen containing organic compounds which include a plurality of carboxylic acid groups including ethylenediamine mono-, di- or tri-acetic acid, ethylenediaminetetraacetic acid. It is to be understood that by the term "essentially free", the compositions comprise less than 0.05% wt. of the total composition, preferably less than 0.025% wt., and most preferably less than 0.01% wt. of such chelating agents.

As is noted above, the compositions according to the invention are largely aqueous in nature. Water is added to order to provide to 100% by weight of the compositions of the invention. The water may be tap water, but is preferably distilled and is most preferably deionized water. Desirably, the compositions of the invention comprise at least 78% wt. water, more desirably at least 80% wt., and most desirably comprise at least 82.5% water.

According to a particularly preferred aspect of the invention there is provided an alkaline ready to use cleaning and sanitizing composition which is essentially free of a chelating agent based on an organic acid compound, especially nitrogen containing chelating agents which composition which composition is particularly adapted to be used as a 'ready-to-use' type composition, as well as in a non-pressurized container which is supplied with a hand pumpable trigger spray apparatus and which is particularly directed for the effective removal of soap scum stains on hard surfaces which comprises:

0.4–0.6% wt. of an amine oxide surfactant, preferably a lauryl dimethyl amine oxide surfactant;

0.6–0.9% wt. of a nonionic alkoxylated alcohol surfactant;

0.05–0.1% wt. of a quaternary ammonium compound as a germicide constituent;

6–8% wt. of a glycol ether as an organic solvent constituent;

2–3% wt. a carbonate constituent;

0.1–0.2% wt. of a hydroxide constituent;

at least 80% wt., preferably at least 82% wt. water, and, optionally, a minor amount of one or more conventional additives including coloring agents, fragrances, opacificers, thickening agents, pH adjusting agents, buffers;

wherein the total amounts of the surfactant constituents does not exceed 2.0% wt. It is a surprising and advantageous feature of the inventive compositions, that very effective cleaning of soap scum, and sanitization of hard surfaces is achieved in such a ready to use composition which contains such a low level of surfactants and at the same time being essentially free of chelating agents based on organic acid compounds, especially nitrogen containing organic compounds which include a plurality of carboxylic acid groups.-

Such materials which may be used to produce the compositions according to the present invention are known to the art. For any particular composition, such optional ingredients should be compatible with the other ingredients present.

Such a hard surface cleaning composition according to the invention is desirably provided as a ready to use product which may be directly applied to a hard surface. Hard surfaces which are to be particularly denoted are those where soap scum are prone to be found, i.e., lavatory fixtures such as shower stalls, bathtubs and bathing appliances (racks, curtains, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces. It is to be particularly noted that due to the alkaline characteristics of the inventive composition, the compositions taught herein are particularly useful in the cleaning and sanitization of so-called European porcelain surfaces.

The following examples below illustrate exemplary and preferred formulations of the compositions according to the invention.

Throughout this specification and in the accompanying claims, weight percents of any constituent are to be understood as the weight percent of the active portion of the referenced constituent, unless otherwise indicated.

EXAMPLES

The following examples illustrate the formulation and performance of various compositions of the invention.

Exemplary formulations illustrating certain preferred embodiments of the inventive compositions and described in more detail in Table 1 below were formulated generally in accordance with the following protocol. The weight percentages indicated the "as supplied" weights of the named constituent.

Into a suitably sized vessel, a measured amount of water was provided after which the constituents were added in no specific or uniform sequence, which indicated that the order of addition of the constituents was not critical. All of the constituents were supplied at room temperature, and any remaining amount of water was added thereafter. Certain of the nonionic surfactants, if gelled at room temperature, were first preheated to render them pourable liquids prior to addition and mixing. Mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well mixed characteristics (i.e., stable mixtures) upon standing for extend periods. The compositions of the example formulations are is listed on Table 1.

TABLE 1

| | Ex.1 | Ex.2 | Ex.3 | Ex.4 | Ex.5 | Ex.6 | Ex.7 | Ex.8 | Ex.9 | Ex.10 |
|---|---|---|---|---|---|---|---|---|---|---|
| C8 Amine Oxide (40%) | 1.250 | | | | | | | | | |
| Ammonyx LO (30%) | | 1.670 | | 1.670 | 1.670 | 1.670 | 1.670 | 1.670 | 1.670 | 1.670 |
| Ammonyx CDO Special | | | | | | | | | | |
| Witcolate D5-10 (40%) | | | 1.250 | | | | | | | |
| Neodol 1-9 | | | | 0.600 | 0.600 | | | | | |
| Genapol 26-L-80 | | | | | | 0.600 | 0.600 | 0.600 | 0.600 | 0.600 |
| Genapol 26-L-60 | | | | | | | | | | |
| Dowanol DB | 5.990 | 5.990 | 5.990 | 5.990 | 5.990 | 5.990 | 5.990 | | | |
| Dowanol DPnP | | | | | | | | 5.990 | 5.990 | |
| Dowanol PnP | | | | | | | | | | 5.990 |
| Sodium Carbonate | 2.250 | 2.250 | 2.250 | 2.250 | 2.250 | 2.250 | 2.250 | 2.250 | 2.250 | 2.250 |
| Sodium Hydroxide (25%) | 0.426 | 0.426 | 0.426 | 0.450 | 0.450 | 0.450 | 0.450 | 0.450 | 0.450 | 0.450 |
| BTC-65 (50%) | 0.172 | 0.172 | 0.172 | 0.172 | 0.172 | 0.172 | 0.172 | 0.172 | 0.172 | 0.172 |
| BTC 8358 (80%) | 0.027 | 0.027 | 0.027 | 0.027 | 0.027 | 0.027 | 0.027 | 0.027 | 0.027 | 0.027 |
| Fragrance | 0.108 | 0.108 | 0.108 | 0.108 | 0.140 | 0.108 | 0.140 | 0.108 | 0.140 | 0.140 |
| DI water | q.s. | q.s. | q.s. | q.s. | q.s. | q.s. | q.s. | q.s. | q.s. | q.s. |

TABLE 1

| | Ex.11 | Ex.12 | Ex.13 | Ex.14 | Ex.15 | Ex.16 | Ex.17 | Ex.18 | Ex.19 | Ex.20 |
|---|---|---|---|---|---|---|---|---|---|---|
| C8 Amine Oxide (40%) | | | | | | | | | | |
| Ammonyx LO (30%) | 1.670 | 2.000 | 1.720 | | 1.720 | | 1.720 | | | |
| Ammonyx CDO Special | | | | 1.720 | | 1.720 | | 1.720 | 1.720 | 1.720 |
| Witcolate D5-10 (40%) | | | | | | | | | | |
| Neodol 1-9 | | | | | | | | | | |
| Genapol 26-L-80 | 0.750 | 0.600 | 0.600 | 0.600 | 0.600 | 0.600 | 0.600 | 0.600 | | |
| Genapol 26-L-60 | | | | | | | | | 0.600 | 0.600 |
| Dowanol DB | | | | | | | | | 5.990 | 5.990 |
| Dowanol DPnP | 5.990 | 5.990 | | | 5.990 | 5.990 | 3.000 | 3.000 | | |
| Dowanol PnP | | | 5.990 | 5.990 | | | 2.990 | 2.990 | | |
| Sodium Carbonate | 2.250 | 2.250 | 2.250 | 2.250 | 2.250 | 2.250 | 2.250 | 2.250 | 2.250 | 2.250 |
| Sodium Hydroxide (25%) | 0.450 | 0.450 | 0.450 | 0.450 | 0.450 | 0.450 | 0.450 | 0.450 | 0.450 | 0.450 |
| BTC-65 (50%) | 0.172 | 0.172 | 0.172 | 0.172 | 0.172 | 0.172 | 0.172 | 0.172 | 0.172 | 0.172 |
| BTC 8358 (80%) | 0.027 | 0.027 | 0.027 | 0.027 | 0.027 | 0.027 | 0.027 | 0.027 | 0.027 | 0.027 |
| Fragrance | 0.140 | 0.140 | | | | | | | 0.108 | 0.140 |
| DI water | q.s. | q.s. | q.s. | q.s. | q.s. | q.s. | q.s. | q.s. | q.s. | q.s. |

The identity of the particular constituents is indicated on Table 2.

TABLE 2

| | |
|---|---|
| C8 Amine Oxide (40%) | octyl dimethyl amine oxide, 40% wt. actives |
| Ammonyx LO (30%) | lauryl dimethyl amine oxide, 30% wt. actives, (Stepan Co., Northfield, MI) |
| Ammonyx CDO Special | cocoamidopropylamine oxide, 30% wt. actives, (Stepan co.) |
| Witcolate D5-10 (40%) | sodium 2-ethylhexyl sulfate, 30% wt. actives (Witco Chem. Co.) |
| Neodol 1-9 | linear $C_{11}$primary alcohol ethoxylate, with an average of 9 ethoxy groups, 100% wt. actives (Union Carbide Corp., Danbury CT) |
| Genapol 26-L-80 | linear $C_{12}$-$C_{16}$ primary alcohol ethoxylate, with an average of 9 ethoxy groups, 100% wt. actives (Clariant Corp., Muttenz, Switzerland) |
| Genapol 26-L-60 | linear $C_{12}$-$C_{16}$ primary alcohol ethoxylate, with an average of 7 ethoxy groups, 100% wt. actives (Clariant Corp., Muttenz, Switzerland) |
| Dowanol DB | diethylene glycol monobutyl ether, supplied as Dowanol ® DB (Dow Chem.Co., Midland MI) |
| Dowanol DPnP | dipropylene glycol n-propyl ether supplied as Dowanol ® DPnP (Dow Chem.Co., Midland MI) |
| Dowanol PnP | propylene glycol n-propyl ether supplied as Dowanol ® DPnP (Dow Chem.Co., Midland MI) |
| Sodium Carbonate | anhydrous sodium carbonate, |
| Sodium Hydroxide (25%) | aqueous sodium hydroxide (Occidental Chemical Co., 25% wt. actives) |
| BTC-65 (50%) | alkyl dimethyl benzyl ammonium chloride, 50% wt. actives (Stepan Co., Northfield, MI) |
| BTC-8358 (80%) | alkyl dimethyl benzyl ammonium chloride, 80% wt. actives (Stepan Co., Northfield, MI) |
| Fragrance | proprietary composition, various formulations |
| DI water | deionized water |

Each of the formulations described on Table 1 had a pH of 12 or greater. Certain of the formulations described on Table 1 were subjected to one or more of the following evaluations.

Cleaning Efficacy

The cleaning efficacy of the inventive compositions was evaluated in accordance with the following protocol(s)

Soap Scum (Limescale) Cleaning Test

For the performance of this test the following materials were utilized. As substrate samples: standard square glazed black ceramic tile, measuring 10.8 cm by 10.8 cm. As cleaning medium, a standard cellulose sponge. If the sponge was supplied with a surfactant or other entrained material such were first removed by washing with warm water, either by hand or by machine, followed by complete drying of the sponge. As a test shampoo, a simple moderate-cleaning type containing alkyl ethoxysulfates may be used. An exemplary shampoo composition is listed in the CSMA DCC-16 protocol.

This test is described generally as follows:

Soil Preparation

A "parent" soil is made, based on the following formulation:

| "Parent" soil | % w/w |
|---|---|
| bar soap | 3.90 |
| shampoo | 0.35 |
| clay | 0.06 |
| artificial sebum | 0.15 |
| hard water | 95.54 |

The parent soil was produced according to the following steps: First, the bar soap was shaved into a suitable beaker. Afterward the remaining constituents were added in the order given above and stirred with three-blade propeller mixer. Next, the contents of the beaker was heated to 45–50° C. and mixed until a smooth, lump-free suspension was achieved. This usually required about two hours with moderate agitation. Subsequently, the contents of the beaker were filtered through a Buchner funnel fitted with Whatman #1 filter paper or equivalent. The filtrate was then resuspended in clean, deionized water, using the same amount of water used to make the soil, and this was filtered again. The (re-filtered) filtrate was uniformly dried overnight at 45° C. to form a filter cake. Thereafter, the filter cake was pulverized and was suitable for immediate use, or may be stored in a sealed container for up to six months.

Substrate Preparation:

The test substrates (tiles) were prepared in the following manner: each tile was thoroughly washed (using a commercially available hand dishwashing detergent, Dove®, and scrubbed using a non-metallic scouring pad (such as a Chore Boy® Long Last scrubbing sponge). The washed tiles were then permitted to dry in an oven at 40.5° C. overnight, then withdrawn and allowed to cool to room temperature (approx. 20° C.) before being provided with the standardized "hard water" test soil. It is to be noted that for each test, new tiles were utilized, namely, the tiles were not reused.

In preparation for supplying the tiles with an amount of the test soil, a test soil was prepared based on the following formulation:

| Test soil: | % w/w |
|---|---|
| "Parent" soil (as indicated above) | 4.50 |
| hard water | 9.0 |
| hydrochloric acid (0.1 N) | 0.77 |
| acetone | 85.73 |

The test soil was produced according to the following steps: The constituents indicated were introduced into a clean beaker, with the acetone being added prior to the water, and the 'parent' soil being added last. The contents of the beaker were mixed using a standard three blade laboratory mixer until the contents formed a uniform mixture, and the color changed from white to gray. This typically required 20–40 minutes, during which time the beaker was covered as much as possible to avoid excessive solvent loss. Next, a suitable quantity of the contents of the test soil from the beaker was provided to an artist's airbrush while the beaker was swirled to ensure a soil uniformity. (If testing required more than one day, a fresh amount of test soil was prepared daily and used for that day's testing.)

Soil was applied to a number of clean, dry tiles placed into rows and columns in preparation for depositing of the test soil. The airbrush was operated at 40 psi, and the test soil was sprayed to provide a visually uniform amount of soil onto the tiles. (Uniform soil suspension during application was maintained by continuous brush motion and/or swirling of test soil in the airbrush.) In this manner, approximately 0.10 g–0.15 g test soil were applied per tile.

The tiles were then allowed to air dry for approximately 30 minutes, during which time the a laboratory hotplate was preheated to approximately 320° C. Each tile was sequentially placed on the hotplate until the test soil began to melt, thereby "aging" the test soil. The melting of the test soil was observed carefully, and each tile was removed shortly before the soil began to coalesce into large droplets. This process was repeated for each tile, allowing the hotplate to recover to 320° C. between tiles. Subsequently each tile was permitted to cool for at least about 30 minutes.

Evaluation of the tested tiles was in accordance with the manner described previously.

The test results for cleaning of both limescale and hard water stains, which were determined by the "subjective" method by a panelist who was asked to grade the appearance of the cleaned tiles ranking a new, untreated tile "100", and a tile soiled by the protocol described above, but uncleaned as "0". These observations are as follows:

TABLE 3

| | Soap Scum (limescale) |
|---|---|
| Ex.6 | 65 |
| Ex.8 | 55 |
| Ex.10 | 67 |
| Ex.1 | 62 |
| Ex.4 | 64 |

These results indicate that the tested formulations provided excellent performance.

Antimicrobial Efficacy

The inventive compositions are expected to exhibit good antimicrobial. efficacy.

What is claimed is:

1. Alkaline ready to use cleaning and sanitizing composition which is essentially free of a chelating agent based on a organic acid compound, which is particularly directed for the effective removal of soap scum stains on hard surfaces comprising:

an amine oxide surfactant;

a nonionic alkoxylated alcohol surfactant;

a quaternary ammonium compound which may be represented by the structural formula:

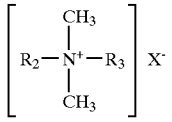

wherein $R_2$ and $R_3$ are the same or different $C_8$-$C_{12}$alkyl, or $R_2$ is $C_{12-16}$alkyl, $C_{8-18}$ alkylethoxy, $C_{8-18}$ alkylphenolethoxy and $R_3$ is benzyl, and X is a halide or is a methosulfate anion, organic solvent constituent;

an alkali metal or alkaline earth metal carbonate constituent;

an alkali metal or alkaline earth metal hydroxide constituent, optionally, a minor amount of one or more conventional additives including coloring agents, fragrances, opacificers, thickening agents, pH adjusting agents, buffers; and, water.

2. The composition according to claim 1 wherein the composition is essentially free of a nitrogen containing chelating agents.

3. The composition according to claim 1 wherein the nonionic alkoxylated alcohol surfactant is $C_{12}$–$C_{16}$ aliphatic alcohol having an average of about 8–10 moles of ethoxylation per mol of alcohol.

4. The composition according to claim 1 which comprises one or more amine oxide surfactants which may be represented by the following structure:

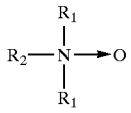

wherein:

each R1 independently is a straight chained or branched $C_1$–$C_4$ alkyl group, but preferably both R1 are methyl groups; and, R2 is a straight chained or branched $C_8$–$C_{18}$ alkyl group, preferably is a $C_8$–$C_{12}$ alkyl group.

5. A composition according to claim 1 wherein the total amounts of the surfactants do not exceed 2.0% wt. of the composition.

6. An alkaline ready to use cleaning and sanitizing composition according to claim 1 which comprises:

0.4–0.6% wt. of an amine oxide surfactant;

0.6–0.9% wt. of a nonionic alkoxylated alcohol surfactant;

0.05–0.1% wt. of a quaternary ammonium compound as a germicide constituent;

6–8% wt. of a glycol ether as an organic solvent constituent;

2–3% wt. a carbonate constituent;

0.1–0.2% wt. of a hydroxide constituent;

at least 80% wt., preferably at least 82% wt. water, and, optionally, a minor amount of one or more conventional additives including coloring agents, fragrances, opacificers, thickening agents, pH adjusting agents, buffers;

wherein the total amounts of the surfactant constituents do not exceed 2.0% wt.

7. A process for the cleaning and disinfecting of a hard surface which comprises the step of:

applying a cleaning and sanitizing effective amount of the composition according to claim 1 to a hard surface.

8. The composition according claim 2 wherein the nonionic alkoxylated alcohol surfactant is $C_{12}$–$C_{16}$ aliphatic alcohol having an average of about 8–10 moles of ethoxylation per mol of alcohol.

9. The composition according to claim 2 which comprises one or more amine oxide surfactants which may be represented by the following structure:

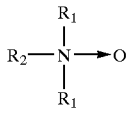

wherein:

each R1 independently is a straight chained or branched $C_1$–$C_4$ alkyl group, but preferably both R1 are methyl groups; and, R2 is a straight chained or branched $C_8$–$C_{18}$ alkyl group, preferably is a $C_8$–$C_{12}$ alkyl group.

10. A composition according to claim 1 wherein the total amounts of the surfactants do not exceed 2.0% wt. of the composition.

* * * * *